United States Patent [19]

Talonen et al.

[11] Patent Number: 4,698,250

[45] Date of Patent: Oct. 6, 1987

[54] METHOD FOR THE MANUFACTURE OF A PRESS FELT AND PRESS FELT

[75] Inventors: Tauno Talonen; Riitta Niemi, both of Tampere, Finland

[73] Assignee: Tamfelt Oy Ab, Tampere, Finland

[21] Appl. No.: 925,478

[22] Filed: Oct. 31, 1986

[30] Foreign Application Priority Data

Nov. 1, 1985 [FI] Finland ..... 854292

[51] Int. Cl.[4] ..... B32B 5/02

[52] U.S. Cl. ..... 428/58; 28/110; 28/117; 156/304.5; 156/304.7; 428/60; 428/61; 428/234

[58] Field of Search ..... 428/58, 60, 61, 234, 428/102; 28/110, 117; 156/304.5, 304.7

[56] References Cited

U.S. PATENT DOCUMENTS 4,271,222 6/1981 Hahn ..... 428/60

4,435,457 3/1984 Servo et al. ..... 428/58

*Primary Examiner*—Marion C. McCamish

*Attorney, Agent, or Firm*—Lowe Price LeBlanc Becker & Shur

[57] ABSTRACT

The invention relates to a method for the manufacture of a press felt for a paper machine and a press felt manufactured by means of said method. The method comprises the manufacture of a seamed fabric and the needling of a fibrous layer on at least one side of the seamed fabric. the fibrous layer is incised in such a way that the seam of the seamed fabric can be opened by removing a connecting thread and correspondingly rejoined after the press felt is mounted in the paper machine by passing the connecting thread back in place so as to join the press felt into an endless loop. In order to eliminate the marking caused by the seam, and in order to increase the water space, at least one surface fabric is provided on at least one surface of the seamed fabric between the seamed fabric and the fibrous layer. The incision of the fibrous layer is made through the surface fabric/surface fabrics up to the seamed fabric.

12 Claims, 3 Drawing Figures

METHOD FOR THE MANUFACTURE OF A PRESS FELT AND PRESS FELT

Figure 1:
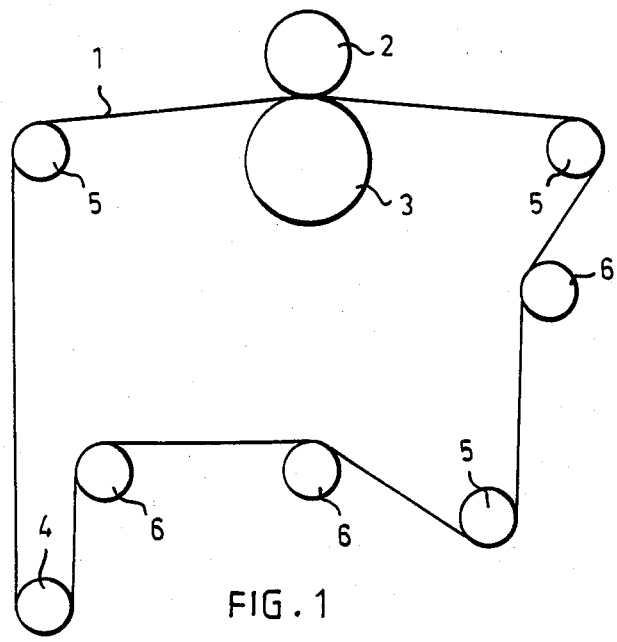

The invention relates to a method for the manufacture of a press felt for a paper machine, comprising the steps of manufacturing a seamed fabric, needling a fibrous layer on at least one side of the seamed fabric, and incising the fibrous layer in such a way that the seam of the seamed fabric is openable by removing a connecting thread and correspondingly rejoinable after the press felt is mounted in the paper machine by passing the connecting thread back in place so as to join the press felt into an endless loop. The invention is also concerned with a press felt manufactured by said method.

The function of a press felt in a paper or a board machine is to lead the paper web or the board material through the press section and to receive water from the wet paper web or board material. The water is removed from the paper web or the board material into the press felt under the influence of pressure. The paper web or the board material is led through the press rolls on a press felt so that the press effect caused by the rolls removes the water from the paper web or the board material into the press felt. A paper machine or a board machine may comprise several consecutive press nips formed by the press rolls so that the paper web or the board material could be dewatered as well as possible. This minimizes the energy costs of the drying section positioned after the press section.

In general, the press felts are either endless or seamed. The bottom fabric of endless press felts is woven into a continuous hose, and a fibrous layer is needled on one or both sides of the bottom fabric. Endless press felts are difficult to mount in the press of a paper or a board machine because the felt has to be passed around the rolls from the side. In practice, this takes plenty of time because the ends of the rolls and the bearing housings thereof, which remain within the felt loop, have to be detached from the frame and lifted off their place before the endless felt can be mounted in the machine. The mounting is even more difficult on account of the fact that the felts which are now in use are extremely stiff, so that they are difficult to handle, and plenty of room is required around the press section when they are mounted in place.

In seamed press felts, the bottom fabric is woven into a planar fabric the ends of which are provided with links. After the needling of the fibrous layer(s), the bottom fabric is joined into a closed loop by means of a seam thread passed through the overlapping links. An example of this kind of solution would be the press felt disclosed in Finnish Patent Application No. 833,970.

An advantage of seamed press felts is that they are considerable simpler to mount than endless felt. This is due to the fact that it is not necessary to disassemble the rolls of the press part, because the felt can be drawn about the rolls while the seam is still open. The felt is not seamed into an endless loop until it has been mounted in place in the machine. A disadvantage of seamed press felts is their possible marking tendency, i.e. the seam may cause disadvantageous defects in the paper web. In addition, it is difficult to produce felts the bottom fabric of which has more than two layers by means of the present method for the manufacture of seamed felts. This is a matter of great importance because, as mentioned before, the object is to make the dewatering in the press section as efficient as possible.

An efficient dewatering, however, requires the use of a sufficiently thick felt of several layers, and the seamed structure according to said Finnish Patent Application cannot be used in this kind of felts.

The object of the invention is to provide a press felt which avoids the disadvantages of prior solutions. This is achived by means of a method according to the invention which is characterized in that said method further comprises the steps of providing at least one surface fabric at least on one surface of the seamed fabric between said seamed fabric and the fibrous layer, and making the incision through the surface fabric/s up to the seamed fabric.

The press felt manufactured by the method according to the invention, in turn, is characterized in that said press felt further comprises at least one surface fabric which is provided at least on one surface of the seamed fabric between said seamed fabric and the fibrous layer, said incision extending through the surface fabric/s up to the seamed fabric.

As compared with prior solutions, the invention is advantageous mainly in that the press felt obtained is sufficiently thick in spite of the seamed structure, by virtue of which the felt can be mounted rapidly in the machine. The sufficiently thick structure provides a large water space which ensures an efficient dewatering. Furthermore, the surface of the press felt according to the invention is extremely smooth, so that no disadvantageous marking of the web occurs. The solution according to the invention allows an extremely flexible manufacture of a seamed fabric, i.e. the seamed structure can be manufactured or chosen fairly freely according to the conditions and requirements in each particular case. Further, the method according to the invention is advantageous in costs, so that the price of a press felt manufactured by the method is very competitive as compared with known felts.

Figure 2:
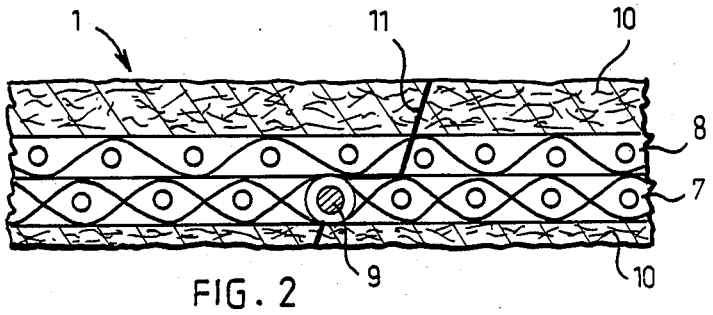
Figure 3:
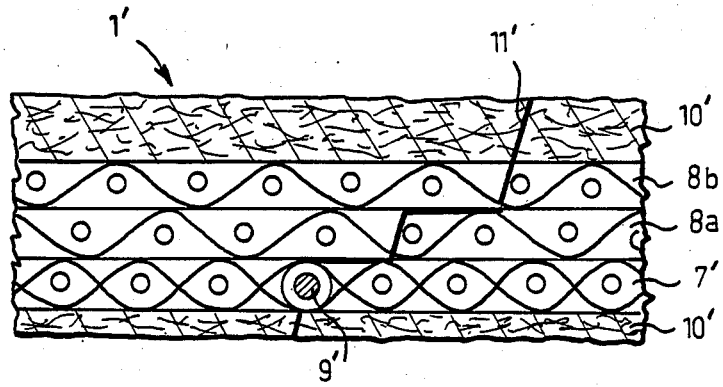

The invention will be described more closely in the following with reference to the preferred embodiments shown in the attached drawings, wherein FIG. 1 is a general view of a part of the press section of a paper machine, FIG. 2 is a general cross-sectional view of one embodiment of the felt according to the invention seen in the transverse direction of the felt, and FIG. 3 is a general cross-sectional view of another embodiment of the felt according to the invention seen in the transverse direction of the felt.

FIG. 1 illustrates generally part of the press section of a paper machine. In the part shown in FIG. 1 a press felt 1 is led between two press rolls 2 and 3. The press felt 1 is thereby passed around a stretch roll 4 and guide rolls 5 positioned inside the felt loop. By way of example, a few guide rolls 6 positioned outside the felt loop are also illustrated in FIG. 1.

If the press felt is an endless felt, the bearings of the rolls 3, 4 and 5 within the felt loop have to be detached on one side of the machine before the mounting of the press felt. It is difficult and time-consuming as such to detach the bearings, and, in addition, present press felts are heavy and stiff, so that they are difficult to handle, and plenty of room is required around the paper machine during the handling thereof. Therefore the replacement of the felt increases greatly the operating costs of the paper machine because of the high costs of long downtimes.

For the above reasons, attempts have been made for a long time to provide a seamed press felt which could be mounted considerably more rapidly than an endless felt. However, previous attempts to provide a seamed press felt which would have sufficiently high dewatering properties and would not damage the web during the pressing step have not been succesful.

Now the method and the felt according to the invention offer a solution to this problem. The manufacture of a press felt by means of the method according to the invention will be described in the following with reference to the embodiments of FIGS. 2 and 3.

According to the invention a seamed fabric 7 is manufactured by means of a weaving machine. The fabric 7 is e.g. a conventional fabric of one fabric layer, and it may comprise one or more layers. In addition, a surface fabric 8 is woven with the weaving machine. The separate surface fabric 8 can be woven e.g. into an endless circular fabric, or it can be woven into a mat fabric, i.e. a fabric which has ends.

At the needling stage the seam of the seamed fabric 7 is closed in such a way that the links at the ends of the fabric are positioned so as to overlap each other, a connecting thread 9 is passed through links which are in alignment, and the seamed fabric 7 and the surface fabric 8 are positioned one on the other. Thereafter a fibrous layer is folded on the fabric structure and needled fast both on the right and the reverse side. The fibrous layer thereby fastens the fabrics and binds them tightly together. After the needling the felt is finished and exposed to a thermal treatment.

Finally, the connecting thread 8 is removed, and the fibrous layer 10 and the surface fabric 8 are incised up to the seamed layer 7 so that the ends can be drawn apart.

As the ends of the felt are apart from each other, the felt can be drawn in place in the paper machine advantageously in the longitudinal direction, so that it is not necessary to detach the bearings of the rolls. After the felt has been positioned in place in the paper machine, the end portions of the felt are positioned against each other, and the connecting thread 9 is passed in place so that the felt again forms an endless loop. A flap formed by the surface fabric 8 thereby covers the seam point after the joining of the end portions.

In this way a thick fabric is provided which is easy to mount in place, has a large water space and a smooth surface formed by the tight surface fabric and the fibrous layer so that the possible marking tendency is eliminated.

In the example of FIG. 2, one surface fabric 8 only is provided. It is, however, possible to choose the number of the surface fabrics completely freely. In the embodiment of FIG. 3, there are two surface fabrics 8*a* and 8*b*. The seamed fabric is indicated with the reference numeral 7' in FIG. 3; the connecting thread with the reference numeral 9', and the fibrous layers with the reference numeral 10'.

The incision line going up to the surface of the seamed fabric 7, 7' is indicated by the reference numerals 11 and 11' in the figures.

As mentioned before, the surface fabric 8, 8*a*,8*b* can be woven into an endless circular fabric or into a mat fabric. If the surface fabric is mat fabric, the end portions thereof can be positioned against each other to form a butt joint. Thereby the incision 11, 11' can be made at said butt joint. If more than one surface fabrics are provided, the butt joints can be arranged stepwise with respect to each other so that the incision line 11', too, is stepped, as shown in FIG. 3. When endless fabrics are used as surface fabrics, it is possible to incise the surface fabrics rectilinearly up to the seamed fabric; on the other hand, it is also possible to use a stepped incision when the surface fabrics are endless fabrics. An endless fabric and a mat fabric can also be used as surface fabrics in one and the same press felt. In the embodiment of FIG. 3, a flap formed by the surface fabrics 8*a*, 8*b* covers the seam after the ends have been joined together.

The seamed fabric 7 can be e.g. a fabric of one fabric layer, and it may comprise one or more layers, as already mentioned above. However, this is not the only possibility, but the seamed fabric 7 can also be e.g. a spiral wire. Further, the seamed fabric can be manufactured of sheets of determined dimensions, which sheets are connected with each other by means of joints. These connecting joints can be similar to those shown in FIGS. 2 and 3. However, a difference is that these joints are not opened after the needling but they act as concealed joints. The joints do not cause any disadvantageous marking phenomenon because the tight surface fabric/s form/s an unbroken smooth surface.

The above embodiments are by no means intended to restrict the invention, but the invention can be modified within the scope of the claims in various ways. Accordingly, the felt or the parts thereof do not, of course, need to be exactly similar to those shown in the figures, but other kind of solutions are possible as well. For instance, it is possible to position a surface fabric/ surface fabrics on the lower surface of the seamed fabric, if this is regarded as necessary. The seamed fabric and the surface fabric/s can also be fastened on each other in some other way than by needling, e.g. by sewing. The surface fabrics can be incised e.g. as shown in FIG. 2 or stepwise so that a flap formed e.g. by the surface fabric and the fibrous layer covers the seam, as illustrated in FIG. 3. It is self-evident that the felt structure of FIG. 2, too, can be provided with such a flap. The flap formed at the incision point can be fastened after the seaming of the felt e.g. by glueing or by means of a small-sized needling machine. Since the flap has been incised at the seam, the needles do not damage the seam itself if a needling machine is used. The surface fabric can also be a seamed fabric which is then incised at the seam. An example of this kind of applications would be a structure corresponding to the embodiment of FIG. 3, wherein the other surface fabric is formed by a seamed fabric, etc.

What is claimed is:

1. A press felt for a paper machine, comprising a seamed fabric and a fibrous layer needled at least on one side of the seamed fabric, the fibrous layer being incised in such a way that the seam of the seamed fabric is openable by removing a connecting thread and correspondingly rejoinable after the press felt is mounted in place in the paper machine by passing the connecting thread back in place so as to join the press felt into an endless loop, said press felt further comprising at least one surface fabric, which is provided at least on one surface of the seamed fabric between said seamed fabric and the fibrous layer, said incision extending through the surface fabric/s up to the seamed fabric.

2. A press felt according to claim 1, wherein the seamed fabric and the surface fabric/s are fastened on each other by needling.

3. A press felt according to claim 1, wherein the seamed fabric and the surface fabric/s are fastened on each other partly by needling and partly by sewing.

4. A press felt according to claim 1, wherein the seamed fabric comprises one or more layers.

5. A press felt according to claim 1, wherein the seamed fabric is a spiral wire.

6. A press felt according to claim 1, wherein the surface fabric/s is/are a woven endless circular fabric/-woven endless circular fabrics.

7. A press felt according to claim 1, wherein the surface fabric/s is/are a woven mat fabric/woven mat fabrics the end portions of which are positioned against each other to form a butt joint/butt joints, and that the incision is made at the butt joint/s.

8. A method for the manufacture of a press felt for a paper machine, comprising the steps of, manufacturing a seamed fabric, needling a fibrous layer on at least one side of the seamed fabric, and incising the fibrous layer in such a way that the seam of the seamed fabric is openable by removing a connecting thread and correspondingly rejoinable after the press felt is mounted in the paper machine by passing the connecting thread back in place so as to join the press felt into an endless loop, wherein said method further comprising at least the steps of providing at least one surface fabric at least on one surface of the seamed fabric between said seamed fabric and the fibrous layer, and making the incision through the surface fabric/s up to the seamed fabric.

9. A method according to claim 8, wherein the seamed fabric and the surface fabric/s are fastened on each other by needling.

10. A method according to claim 8, wherein the seamed fabric and the surface fabric/s are fastened on each other partly by needling and partly by sewing.

11. A method according to claim 8, wherein the surface fabric/s is/are woven into a mat fabric, and the end portions of the fabric/s are positioned against each other to form a butt joint/ butt joints, and that the incision is made at the butt joint/butt joints.

12. A method according to claim 11, wherein the butt joints of the surface fabrics positioned one upon the other are arranged in a stepped relation with respect to each other.

* * * * *